US006904860B1

(12) United States Patent
Dubois et al.

(10) Patent No.: US 6,904,860 B1
(45) Date of Patent: Jun. 14, 2005

(54) WINGLET FOR THE TRAILING END OF TOWED FLEXIBLE UNDERWATER LINES

(75) Inventors: Neil J. Dubois, Cranston, RI (US); Bruce E. Sandman, Tiverton, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/825,636

(22) Filed: Apr. 16, 2004

(51) Int. Cl.[7] ..... B63G 8/14
(52) U.S. Cl. ..... 114/245
(58) Field of Search ..... 114/242, 243, 244, 114/245, 249; 367/15, 18, 19, 191

(56) References Cited

U.S. PATENT DOCUMENTS 3,375,800 A * 4/1968 Buller et al. ..... 114/245
3,440,992 A * 4/1969 Chance ..... 114/245
3,605,674 A * 9/1971 Weese ..... 114/245
3,943,483 A * 3/1976 Strange ..... 367/17
3,987,745 A * 10/1976 Chaverebiere de Sal et al. ..... 114/245
4,759,001 A * 7/1988 Keckler et al. ..... 367/191
5,402,745 A * 4/1995 Wood ..... 114/244
5,596,943 A * 1/1997 Horton ..... 114/245
5,673,644 A * 10/1997 Vanasse et al. ..... 114/242

* cited by examiner

*Primary Examiner*—Lars A. Olson
(74) *Attorney, Agent, or Firm*—James M. Kasischke; Michael F. Oglo; Jean-Paul Nasser

(57) ABSTRACT

A winglet for mounting on a trailing end of a flexible line to be towed by an underwater vehicle includes an internal collar member for connection to an inside surface of the line at the trailing end thereof, an outer collar member for connection to an outside surface of the line outboard of the internal collar, and connection means for fixing the internal and outer collar members to the line trailing end. A plurality of fins are mounted on an outside surface of the outer collar member and extend outwardly from the outer collar member.

8 Claims, 3 Drawing Sheets

WINGLET FOR THE TRAILING END OF TOWED FLEXIBLE UNDERWATER LINES

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION

1. Field of the Invention

The invention relates to the movement of towed underwater lines and is directed more particularly to a winglet for mounting on a trailing end of such lines and operating to improve stability of the line during towing.

2. Description of the Prior Art

Underwater vehicles, such as submarines and unmanned underwater vehicles (UUV), may be provided with a somewhat flexible line which can be paid out of the submerged vehicle and towed through the water by the vehicle. Typically, the line extends from a bow portion of the vehicle. The line is often provided with a multiplicity of acoustic sensor elements. While the line is somewhat flexible, it also exhibits some rigidity, such that when the line is being towed through the water, the line tends to bend rearwardly and well outwardly from the vehicle.

The vehicle is provided with a stabilizing tether which is paid out from the stern area of the vehicle and at its distal end is fastened to the towed line proximate the distal end thereof. The stabilizing tether is reeled in to bring the trailing end of the towed line in nearer the vehicle. The tether is under tension and provides some measure of stability to the towed line.

Nonetheless, the trailing end of the towed line is subject to substantial vibration which is unwanted inasmuch as the acoustic, or other measuring devices or sensors carried in the towed line, may be highly position dependent. That is, to gain the most from the measuring devices or sensors, it is required that the precise positions of the devices be known on a continuing basis. There is thus a need to diminish and limit the vibrational movement of the trailing end of the towed line.

SUMMARY OF THE INVENTION

An object of the invention is, therefore, to steady and stabilize the towed line so as to improve pin-pointing the positions of instruments carried in the line.

With the above and other objects in view, a feature of the invention is the provision of a winglet for mounting on a trailing end of a flexible line to be towed by an underwater vehicle. The winglet comprises an internal collar member for connection to an inside surface of the line at the trailing end thereof, and an outer collar member for connection to an outside surface of the line outboard of the internal collar. Connection means are provided for fixing the internal and outer collar members to the line trailing end, and a plurality of fins are mounted on an outside surface of the outer collar member and extend outwardly from the outer collar member.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent, wherein corresponding reference characters indicate corresponding parts throughout the several views of the drawings and wherein.

DESCRIPTION OF THE PREFERRED EMBODIMENTS

Figure 1:
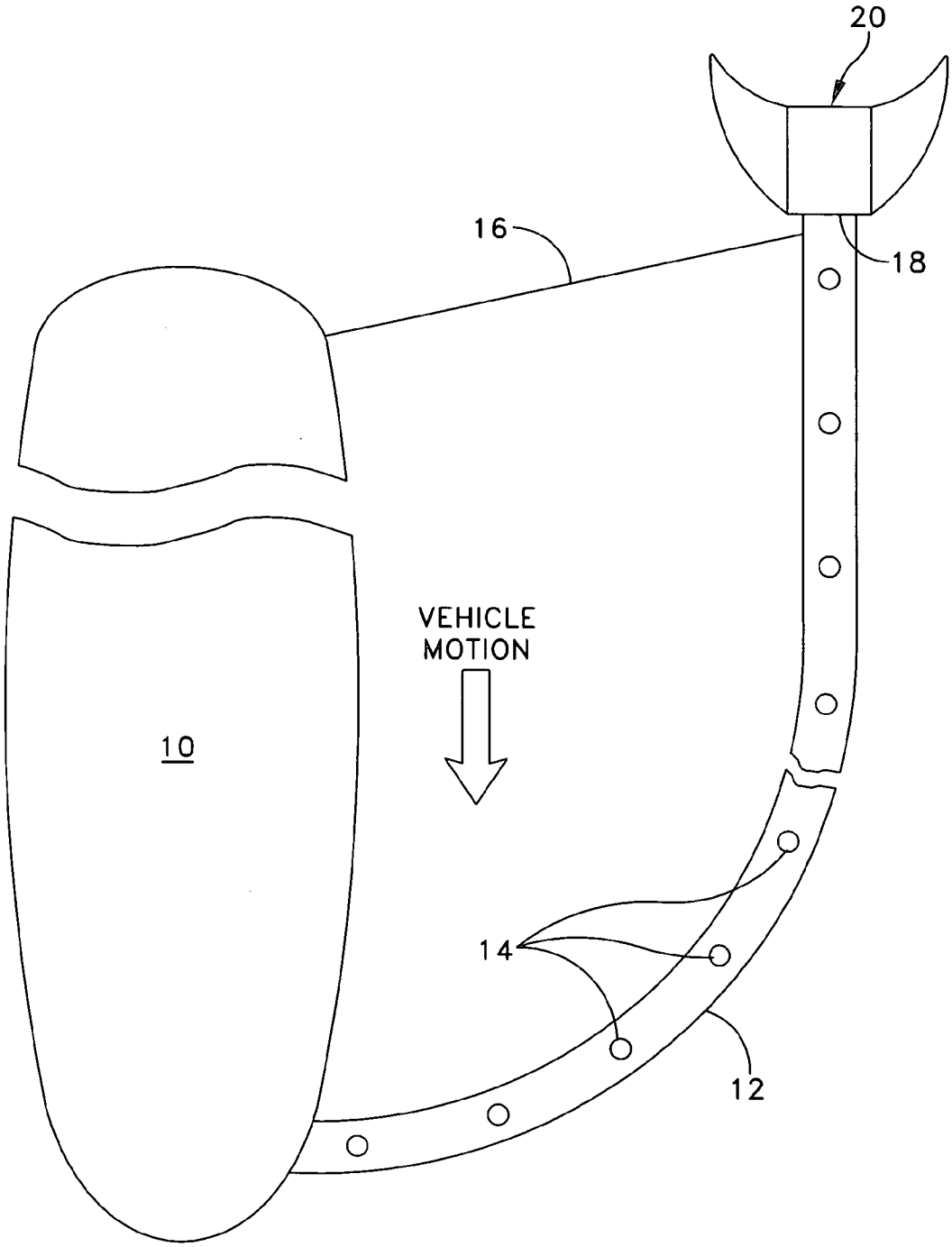
FIG. 1 is a diagrammatic representation of an underwater vehicle having a flexible line extending therefrom, with a winglet in accordance with the present invention fixed on a trailing end of the line.

Referring to FIG. 1, it will be seen that an underwater vehicle 10 is provided with a hollow line 12 extending from a bow area of the vehicle and in which are disposed a series of sensors or measuring devices 14, typically acoustic devices. A tether 16 extends from the stern area of the vehicle 10 and is connected to a trailing end 18 of the line 12 to stabilize the end 18, as described hereinabove.

To further stabilize the line 12 and the devices 14, and in accordance with the invention, there is provided a winglet device 20 for attachment to the trailing end 18 of the line 12.

Figure 2:
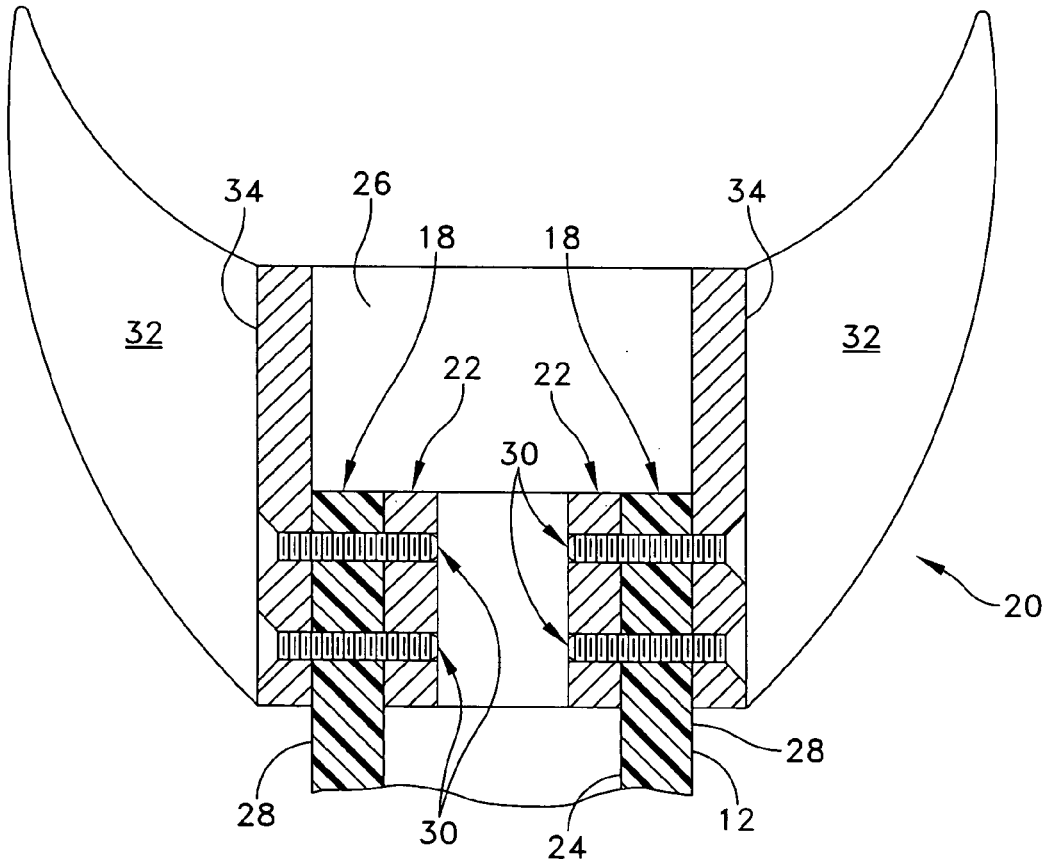
FIG. 2 is a sectional enlarged view of the winglet of FIG. 1.

Referring to FIG. 2, it will be seen that the winglet 20 includes a cylindrically shaped internal collar member 22 for connection to an inside surface 24 of the line 12 proximate the trailing end 18 thereof. The winglet 20 further includes a cylindrically shaped outer collar member 26 for connection to an outside surface 28 of the line 12 outboard of the internal collar member 22.

Connection means 30, usually fasteners, such as bolts, are provided for fixing the internal and outer collar members 22, 26 to the line trailing and 18, as shown in FIG. 2. Alternatively, the winglet 20 may be adhesively bound to the line 12, or, depending upon the material from which the winglet is made, may be molded integrally with the line 12.

A plurality of fins 32 are mounted on an outside surface 34 of the outer collar member 26 and extend outwardly, or outboard, from the outer collar member 26.

While the winglet 20 may be molded of the same material as the line 12, it is presently preferred that the winglet be fabricated from a light-weight, corrosion-resistant metal, such as aluminum. Such a winglet, along with mechanical connection means 30, facilitate use of the winglet as an "add-on" to lines 12 currently in use.

Figure 3:
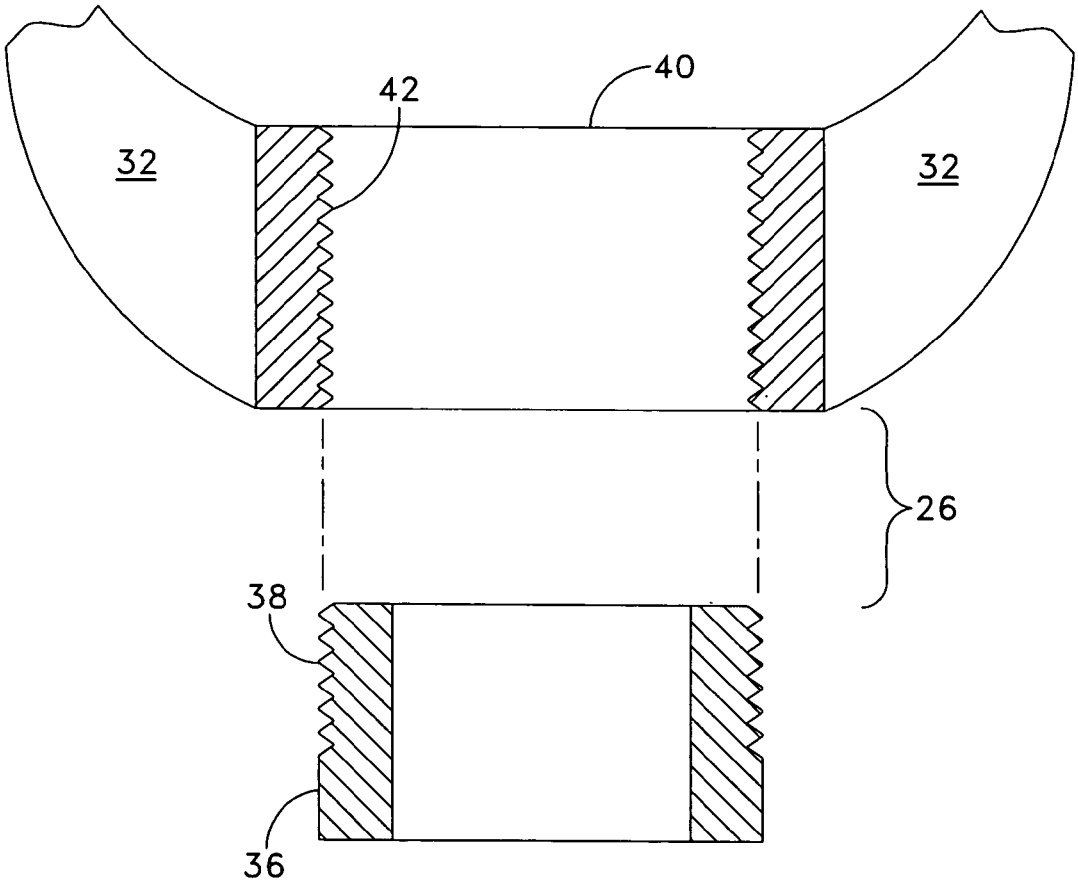
FIG. 3 is a sectional view, similar to FIG. 2, but illustrative of an alternative embodiment.

Referring to FIG. 3, it will be seen that an alternative embodiment of the outer collar member 26 includes a first component 36 having threads 38 at an after end thereof, and a second component 40 having threads 42 thereon engageable with the first component threads 38. The fins 32 are fixed to the second component 40, which may be threadedly attached to and removed from the first component 36 which, in turn, is fixed to the line 12.

The embodiment of FIG. 3 enables the quick and easy replacement of fins, either because of damage or because of the desirability of a particular fin configuration for a particular task.

There is thus provided a winglet which may be affixed to the trailing end of a line to be towed by an underwater vehicle to steady and stabilize the trailing end of the towed line, to improve positional accuracy of instruments carried in the line.

It will be understood that many additional changes in the details, materials, and arrangement of parts, which have been herein described and illustrated in order to explain the nature of the invention, may be made by those skilled in the art within the principles and scope of the invention as expressed in the appended claims.

What is claimed is:

1. A winglet for mounting on a flexible line to be towed by an underwater vehicle, the winglet comprising:

an internal collar member for connection to an inside surface of the line;

an outer collar member for connection to an outside surface of the line outboard of said internal collar;

connection means for fixing said internal and outer collar members to the line; and a plurality of fins mounted on an outside surface of said outer collar member and extending outwardly from said outer collar member.

2. The winglet in accordance with claim 1 wherein said connection means comprises fasteners extending through said outer collar member, the line, and said internal collar member.

3. The winglet in accordance with claim 2 wherein said fasteners comprise bolts.

4. The winglet in accordance with claim 1 wherein said collar members are of metal and said line is of a flexible material.

5. The winglet in accordance with claim 3 wherein the metal is aluminum.

6. The winglet in accordance with claim 1 wherein said outer collar member comprises first and second components, said first component having threads at an after end thereof, said second component having threads thereon engageable with the first component threads, and said fins being fixed to said second component;

such that said second component and said fins are removable from said first component which is thereby adapted to receive an alternative second component with an alternative plurality of fins thereon.

7. The winglet in accordance with claim 1 wherein;

the winglet is adapted for mounting on a trailing end of the flexible line;

said internal collar is adapted for connection to the inside surface of the line at the trailing end thereof; and said connection means is adapted for fixing the internal and outer collar members to the trailing end of the line.

8. A flexible line assembly for connection to a bow portion of an underwater vehicle and adapted to be towed by the underwater vehicle, the assembly comprising:

a hollow flexible line for connection at a first end to the underwater vehicle bow portion, a second end of said line being adapted to trail along aft of the vehicle bow portion and spaced outwardly from a stern portion of the vehicle;

a winglet fixed on the second end of said line, said winglet having a plurality of fins mounted thereon; and a tether for extension from the stern portion of the vehicle and adapted to be fixed to the second end of said flexible line;

whereby to stabilize said flexible line positionally as said flexible line is towed by the vehicle.

* * * * *